US009411278B2

(12) United States Patent
Yamano et al.

(10) Patent No.: US 9,411,278 B2
(45) Date of Patent: Aug. 9, 2016

(54) IMAGE FORMING APPARATUS

(71) Applicants: Motoyoshi Yamano, Tokyo (JP); Shinichi Namekata, Kanagawa (JP); Ryota Yamashina, Kanagawa (JP); Takumi Waida, Kanagawa (JP); Shinji Kato, Kanagawa (JP); Shuji Hirai, Tokyo (JP); Terumichi Ochi, Tokyo (JP)

(72) Inventors: Motoyoshi Yamano, Tokyo (JP); Shinichi Namekata, Kanagawa (JP); Ryota Yamashina, Kanagawa (JP); Takumi Waida, Kanagawa (JP); Shinji Kato, Kanagawa (JP); Shuji Hirai, Tokyo (JP); Terumichi Ochi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/474,939

(22) Filed: Sep. 2, 2014

(65) Prior Publication Data

US 2015/0078770 A1 Mar. 19, 2015

(30) Foreign Application Priority Data

Sep. 18, 2013 (JP) ..... 2013-193031

(51) Int. Cl.
*G03G 15/00* (2006.01)
*G03G 15/20* (2006.01)

(52) U.S. Cl.
CPC .. *G03G 15/2046* (2013.01); *G03G 2215/00447* (2013.01); *G03G 2215/00751* (2013.01)

(58) Field of Classification Search
CPC ..... G03G 15/2039; G03G 15/205; G03G 15/5029; G03G 13/20
USPC ..... 399/33, 45, 67–69, 328
See application file for complete search history.

(56) References Cited

U.S. PATENT DOCUMENTS

| | | | | |
|---|---|---|---|---|
| 9,170,544 | B2 * | 10/2015 | Yamashina | G03G 15/5029 |
| 2011/0229179 | A1 * | 9/2011 | Yoshida et al. | 399/67 |
| 2011/0305473 | A1 * | 12/2011 | Tamaki | 399/67 |
| 2013/0209122 | A1 | 8/2013 | Yamashina et al. | |
| 2014/0270822 | A1 * | 9/2014 | Yamashina | G03G 15/2046 399/45 |

FOREIGN PATENT DOCUMENTS

| | | |
|---|---|---|
| JP | 4-315162 | 11/1992 |
| JP | 4-315188 | 11/1992 |
| JP | 10-160687 | 6/1998 |
| JP | 11-271037 | 10/1999 |

(Continued)

OTHER PUBLICATIONS

U.S. Appl. No. 14/193,260, filed Feb. 28, 2014.

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P

(57) ABSTRACT

An image forming apparatus includes paper trays to contain and feed a recording sheet on which a toner image is transferred; status sensors to detect a storage status of the recording sheet contained in the paper trays; a sheet sensor to detect a smoothness of the recording sheet; a memory to store detection values of the smoothness detected by the sheet sensor; a fixing device to heat and press the toner image transferred onto the recording sheet and fix it onto the recording sheet; and a control circuit to determine a target fixing temperature of the fixing device based on the detection values stored in the memory. The control circuit determines the target fixing temperature for successive recording sheets depending on the detected smoothness, and resets the detection values stored in the memory to zero when the status sensors detect a change in the storage status of the paper trays.

8 Claims, 7 Drawing Sheets

(56) References Cited

FOREIGN PATENT DOCUMENTS

| | | |
|---|---|---|
| JP | 2002-340518 | 11/2002 |
| JP | 2004-191853 | 7/2004 |
| JP | 2006-062842 | 3/2006 |
| JP | 2006-126281 | 5/2006 |
| JP | 2011-043683 | 3/2011 |
| JP | 2012-194445 | 10/2012 |
| JP | 2013-178453 | 9/2013 |

* cited by examiner

IMAGE FORMING APPARATUS

CROSS-REFERENCE TO RELATED APPLICATION

This patent application claims priority pursuant to 35 U.S.C. §119(a) from Japanese Patent Application No. 2013-193031, filed on Sep. 18, 2013, the entire disclosure of which is incorporated by reference herein.

BACKGROUND

1. Technical Field

Exemplary embodiments of the present invention relate to an image forming apparatus such as a copier, a facsimile machine, a printer, or a multi-function apparatus combining the capabilities of these devices.

2. Background Art

The image forming apparatuses employing electrophotography, including copiers, facsimile machines, printers, or multi-function apparatuses combining the capabilities of these devices, form an image by fusing a toner image onto a recording medium at a prescribed temperature and pressure, thus fixing the image onto the recording medium.

In an image forming apparatus employing electrophotography, conditions for fixing operation such as a set temperature or pressure need to be considered when fusing and fixing the toner image. In particular, to form a quality image, conditions for fixing the toner image vary depending on the type of the recording medium, because image quality is greatly affected by the type, thickness, humidity, smoothness, and coating of the recording medium.

Smoothness is measured as follows: A test plate is placed against the surface of the recording medium, and a length of time in which a prescribed amount of air flows between the surface of the recording medium and the test plate is measured in seconds. "Coating" here means that the recording medium is coated or printed with ink or coating material.

There is a very high correlation between the smoothness of the recording medium and fixing performance, because a fixing ratio of an image changes depending on a ratio of concavities to convexities in the surface of the recording medium, and in particular in the concave portions of the recording medium. Accordingly, when fixation is performed without the smoothness being considered, a quality image is hardly obtained, and failing to consider the smoothness may cause an abnormal image due to defective fixation.

On the other hand, along with recent improvements in the image forming apparatus and diversification of modes of expression, there are now several hundred varieties of recording media. Further, each recording sheet is not the same and is different due to differences of basis weight and thickness, and many brand sheets exist. Accordingly, to create a quality image, the conditions for fixation need to be set precisely for each type and brand of recording media.

SUMMARY

In one embodiment of the disclosure, there is provided an improved image forming apparatus including paper trays to contain and feed a recording sheet on which a toner image is transferred; status sensors to detect a storage status of the recording sheet contained in the paper trays; a sheet sensor to detect a smoothness in a prescribed area on a surface of the recording sheet; a memory to store detection values of the smoothness detected by the sheet sensor; a fixing device to heat and press the toner image transferred onto the recording sheet and fix the toner image onto the recording sheet; and a control circuit to determine a target fixing temperature of the fixing device based on the detection values stored in the memory. In the image forming apparatus, the control circuit causes the detection values of the recording sheet detected by the sheet sensor to be stored in the memory, causes the sheet sensor to sequentially detect a smoothness of a successive recording sheet and to store a detection value of the smoothness of the successive recording sheet into the memory, determines the target fixing temperature for successive recording sheets depending on the detected smoothness, and resets the detection values stored in the memory to zero when the status sensors detect a change in the storage status of the paper trays.

These and other objects, features, and advantages of the present invention will become apparent upon consideration of the following description of preferred embodiments of the present invention when taken in conjunction with the accompanying drawings.

DETAILED DESCRIPTION

Preferred embodiments of the present invention will be described with reference to accompanying drawings.

Figure 1:
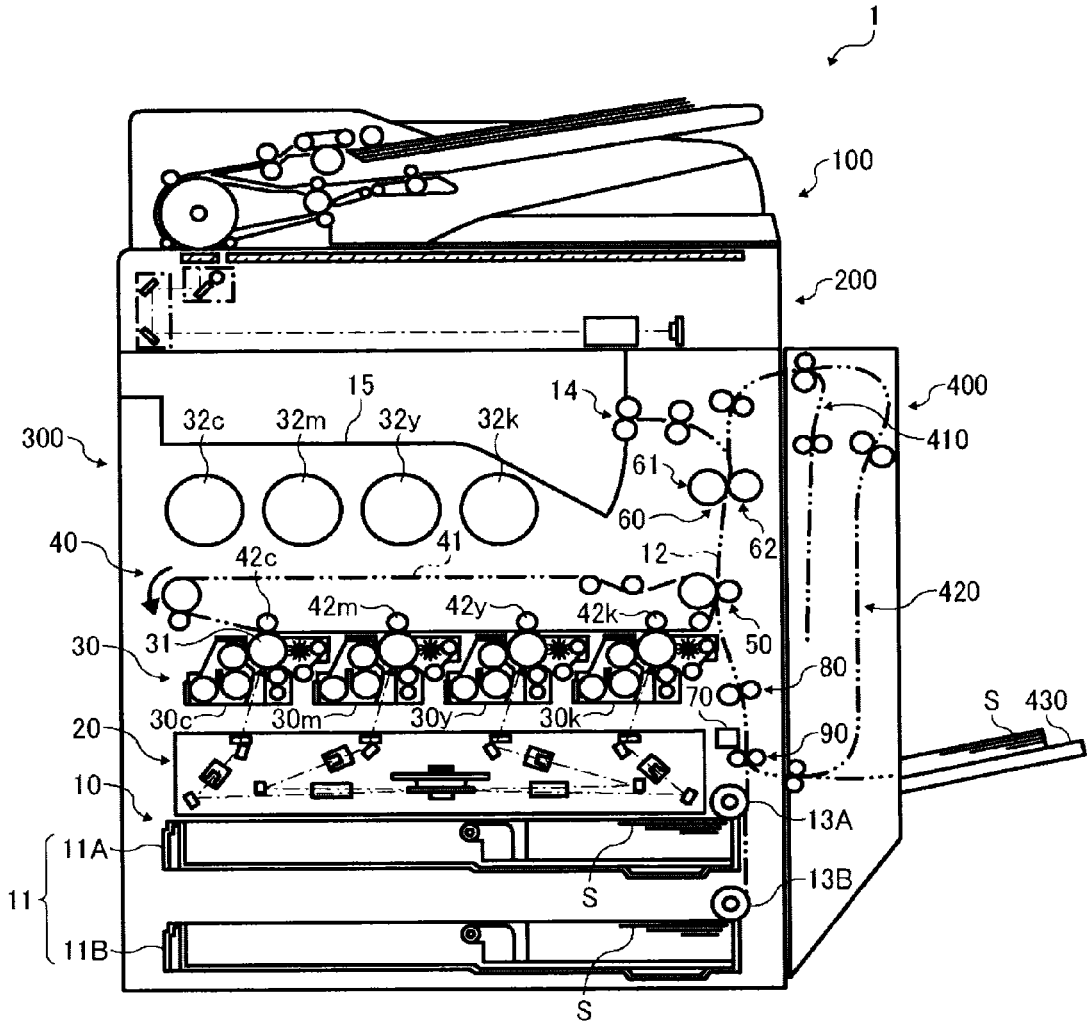
FIG. 1 is a schematic cross-sectional view of an image forming apparatus related to an embodiment of the present invention.

As illustrated in FIG. 1, the image forming apparatus 1 according to the present embodiment employs electrophotography and includes, in order from top to bottom, an original sheet conveyance unit 100, an image scanner 200, an apparatus body 300, and a duplex conveyance unit 400 that is disposed on a side of the main body 300.

The original sheet conveyance unit 100 employs an automatic document feeder (ADF) that automatically and sequentially feeds a topmost sheet from original sheets placed thereon. The ADF can be provided as an option.

The original sheet conveyance unit 100 is openably closable relative to the image scanner 200, and is hinged along the distal end of the image forming apparatus 1. The original sheet conveyance unit 100 may be formed of a conventional structure. Accordingly, description of the original sheet conveyance unit 100 is omitted.

The image scanner 200 is an image scanning device to read both an original sheet being conveyed by the original sheet conveyance unit 100 and a still image of the original placed on a platen of the original sheet conveyance unit 100. Image data of the original sheet read by the image scanner 200 is output to the apparatus body 300. The image scanner 200 may be formed of a conventional structure. Accordingly, description of the image scanner 200 is omitted.

The apparatus body 300 includes a sheet feeder 10, an exposure device 20, an image forming device 30, an intermediate transfer device 40, a secondary transfer device 50, and a fixing device 60 as denoted in an order of image forming process.

The sheet feeder 10 is disposed in the bottom of the apparatus body 300. The sheet feeder 10 includes drawer-type paper trays 11 disposed in two-storied structure in the present embodiment. Specifically, they are an upper paper tray 11A and a lower paper tray 11B disposed vertically, step wisely. The paper trays 11 store recording sheets S as recording media. Each of the paper trays 11A and 11B is provided with a pair of sheet feed rollers 13A and 13B, respectively. Each of the pair of sheet feed rollers 13A and 13B disposed at a downstream end and at an upper portion thereof, feeds a topmost sheet from the paper tray 11A or 11B to send the fed sheet to a conveyance path 12.

The exposure device 20 is disposed at an upper side of the topmost paper tray 11A. The exposure device 20 radiates laser beams to the image forming device 30 based on the image data received from an original sheet or fixed original read by the image scanner 200 or the image data received via a PC or a telephone line.

The image forming device 30 includes, specifically, image forming units 30*c*, 30*m*, 30*y*, and 30*k* for each color of cyan (c), magenta (m), yellow (y), and black (k). The image forming units 30*c*, 30*m*, 30*y*, and 30*k* are serially disposed in 4-tandem method. Each of the image forming units 30*c*, 30*m*, 30*y*, and 30*k* includes a drum-shaped image carrier 31 that rotates in the clockwise direction as illustrated in FIG. 1. Around each image carrier 31, devices for charging, developing, transferring (i.e., a primary transfer), cleaning, and discharging are disposed to perform each operation in this order. Each image forming units 30*c*, 30*m*, 30*y*, and 30*k* is supplied with toner as a developer for each color from toner bottles 32*c*, 32*m*, 32*y*, and 32*k*.

The intermediate transfer device 40 includes an endless intermediate transfer belt 41 that is stretched around a plurality of rollers substantially horizontally and moves to rotate in the counterclockwise direction in the figure. The intermediate transfer device 40 further includes primary transfer devices 42*c*, 42*m*, 42*y*, and 42*k* opposed to each image carrier 31 of the image forming units 30*c*, 30*m*, 30*y*, and 30*k* with the intermediate transfer belt 41 sandwiched in between. The primary transfer devices 42*c*, 42*m*, 42*y*, and 42*k* cause a toner image formed on the image carrier 31 to be transferred to the intermediate transfer belt 41.

The secondary transfer device 50 is disposed on a path of the conveyance path 12 and transfers the toner image as a primarily transferred image formed on the intermediate transfer belt 41 to a recording sheet S as a secondary transfer.

The fixing device 60 includes a heat roller 61 and a pressure roller 62. The heat roller 61 is disposed at a side of the sheet surface and fixes the toner image transferred on the recording sheet S onto the recording sheet S and the pressure roller 62 is disposed at a sheet rear side and presses the recording sheet S against the heat roller 61. The fixing device 60 according to the present embodiment serves as a fixing means.

The fixing device 60 causes the toner image to be fixed onto the recording sheet S by heating and pressurizing the recording sheet S onto which the toner image is secondarily transferred. The apparatus body 300 discharges the recording sheet S after toner fixation from a sheet discharger 14 to a sheet discharge tray 15.

The duplex conveyance unit 400 is used to form images on double sides of the recording sheet S and includes a switchback unit 410 and a reverse unit 420. In addition, the duplex conveyance unit 400 includes a manual sheet feeder 430 serving as a tray, other than the paper trays 11 that contains recording sheets S to be supplied to the apparatus body 300.

The switchback unit 410 switches an upstream end in the conveyance direction of the recording sheet S the image on one side of which is fixed, with a downstream end of the recording sheet S and conveys the recording sheet S to the reverse unit 420. The reverse unit 420 re-feeds the recording sheet S to an upstream end of the conveyance path 12 using a path to supply the recording sheet S from the manual sheet feeder 430 to the apparatus body 300.

A sheet sensor 70 to detect media data of the upstream recording sheet S is disposed between the upper sheet feed roller 13A and the secondary transfer device 50 in the path of the conveyance path 12. In addition, in the conveyance path 12, a registration roller pair 80 to adjust a conveyance timing of the recording sheet S is disposed downstream of the sheet sensor 70. Further, in the conveyance path 12, a conveyance roller pair 90 to convey the recording sheet S is disposed upstream of the sheet sensor 70.

The sheet sensor 70 is disposed upstream of the registration roller pair 80 and calculates smoothness of the recording sheet S supplied from the paper trays 11 or from the manual sheet feeder 430 to the conveyance path 12. The sheet sensor 70 detects smoothness of the recording sheet S used for setting fixing conditions including a fixing temperature, which will be described later. The sheet sensor 70 in the present embodiment is employed as a smoothness detection means.

Because the sheet sensor 70 is disposed downstream of the conveyance roller pair 90, the sheet sensor 70 can obtain smoothness of all recording sheets S passing through the conveyance path 12 without providing the sheet sensor 70 at positions corresponding to the paper trays 11A, 11B, and the manual sheet feeder 430, respectively. Further, because the sheet sensor 70 is disposed upstream of the registration roller pair 80, when the recording sheet S is subjected to the registration process, that is, when the conveyance of the recording sheet S is temporarily stopped, the smoothness of the sheet S is obtained. Accordingly, even when the smoothness is obtained while the sheet S is moving, the accuracy of the obtained smoothness is high. Detailed structure of the sheet sensor 70 will be described later.

Examples of recording sheets include, for example, normal paper; coated sheets such as gloss, matt, and art paper; OHP sheets; and embossed sheets. These types of special sheets are increasing in number year by year. Recording materials other than the recording sheet also exist.

With contemporary image forming apparatus, setting of fixing conditions is generally performed in accordance with the basis weight of the recording medium. Paper, for example, is classified by basis weight into the following three types: Normal paper having a basis weight of from 60 to 90 grams/$m^2$; medium thickness paper having a basis weight of from 91 to 105 grams/$m^2$; and thick paper having a basis weight of from 106 to 300 grams/$m^2$. For each class, fixing temperature and conveyance speed of the recording medium are different.

The basis weight of the recording medium is in general specified on the package so that the user can see it. Such basis weight information for setting fixing conditions is input using a control panel provided to a copier, so that the copier recognizes the settings. In the case of a printer, setting is performed by using a printer driver displayed on an attached personal computer (PC) to allow the basis weight information to be included in the printing information, so that the printer recognizes the settings. On the other hand, if the user needs to set the basis weight information manually via the control panel or using the PC, the setting work before printing is bothersome and a desired high-quality image cannot be obtained if erroneously set.

Provision of a sensor to detect a thickness of the recording medium that allows the apparatus to automatically select a recording medium and perform image formation has been made to cope with the above problem. In addition, generally, the smoothness of the recording medium is not printed on the package and it is very difficult for the user to obtain the smoothness information. Accordingly, the smoothness of the recording medium has to be obtained by a sensor, for example.

As described above, there is a high correlation between the smoothness and the fixation quality. However, the smoothness is measured as the time period in which a prescribed amount of air flows between the surface of the recording medium and the test plate, and therefore, it is difficult to detect the smoothness in a short period of time. Since the smoothness has a high correlation with surface roughness and quantity of reflected light, however, a sensor to measure the surface roughness and the reflected light quantity as an adequate substitute of smoothness is known.

As a conventional method of detecting smoothness, a light emitting element (LED) is used, illumination light emitted from the light emitting element (LED) irradiates the surface of the recording medium, and the quantity of reflected light from the surface of the recording medium is obtained, so that the smoothness of the recording medium is obtained from the reflected light quantity. According to this optical detection method, the smoothness can be obtained without contacting the recording medium, and therefore the recording medium is not damaged.

In addition, as a method for detecting the smoothness using this type of optical detection method, there is a method of detecting a type of material or level of smoothness of the recording medium based on the quantity of light reflected from the surface of the recording medium and the quantity of light permeating the recording medium.

There is also a method in which a light emitting source and two light receiving parts are disposed, light is emitted from the one light emitting source onto the surface of the recording medium, specular reflected light and diffusion reflected light from the light emitting source are received by the two light receiving parts, and the material (smoothness) of the recording medium is detected based on each light quantity by the light receiving parts.

The thus-obtained smoothness is, for example, used for setting fixing conditions such as a fixing temperature and image forming conditions. Accordingly, when the image forming apparatus employs the detected smoothness of the recording medium for setting fixing conditions and image forming condition, the smoothness needs to be detected in advance considering a prescribed time required from starting image formation to transfer onto a transfer sheet and until reaching a target fixing temperature, and therefore, a position of the sensor and a timing for detecting the smoothness are particularly important.

However, for example, when a paper tray that stores the recording media is replaced with another tray that stores recording media having a different smoothness, because a detected value for the previously-used recording media continues to be used as is, a problem occurs in that it takes a longer time until the detected value is changed to the fixing temperature suitable for the new recording media.

To cope with the above problem, one embodiment will be described below.

First, in the image forming apparatus 1, the image scanner 200 reads the original image, and the exposure device 20 writes a latent image for a toner image of each color of the read original image on a surface of the image carrier 31 of each image forming unit 30*c*, 30*m*, 30*y*, or 30*k* that is uniformly charged by the charger.

Then, in the image forming apparatus 1, the developing device applies toner of each color to the latent image formed on each image carrier 31 of each image forming unit 30*c*, 30*m*, 30*y*, or 30*k*, so that the latent image is rendered visible as a toner image.

Next, in the image forming apparatus 1, each toner image formed on the image carrier is sequentially and primarily transferred on the intermediate transfer belt 41 using the primary transfer devices 42*c*, 42*m*, 42*y*, and 42*k*, so that a desired full-color image is formed on the intermediate transfer belt 41.

On the other hand, either the sheet feed rollers 13A or 13B in the two-storied paper trays 11A, 11B is selectively rotated so that the recording sheet S is fed out from the corresponding paper trays 11 or the recording sheet S is fed out from the manual sheet feeder 430.

In the image forming apparatus 1, the recording sheet S fed out from the paper trays 11 or the manual sheet feeder 430 is conveyed to the conveyance path 12.

In the image forming apparatus 1, the recording sheet S conveyed to the registration roller pair 80 via the conveyance path 12 is conveyed to the secondary transfer position of the secondary transfer device 50 at a matched timing, taken by the registration roller pair 80, with the toner image formed on the intermediate transfer belt 41.

Herein, in the image forming apparatus 1, the sheet sensor 70 calculates smoothness of the recording sheet S, and the secondary transfer device 50 transfers the color image on the intermediate transfer belt 41 to the recording sheet S.

Then, in the image forming apparatus 1, the recording sheet S on which the color image is transferred is conveyed to the fixing device 60, is heated and pressed at a nip portion of the fixing device 60, so that the color image is fixed onto the recording sheet S.

Herein, when the image is to be formed on a backside of the recording sheet S, the image forming apparatus 1 causes a switching claw to switch the conveyance path of the recording sheet S one side of which a color image has been transferred to, so that the recording sheet S is conveyed to the duplex conveyance unit 400.

The switchback unit 410 switches an upstream end in the conveyance direction of the recording sheet S with a downstream end of the recording sheet S, and conveys the recording sheet S to the reverse unit 420. The reverse unit 420 re-feeds the recording sheet S to an upstream end of the conveyance path 12 using a path to supply the recording sheet S from the manual sheet feeder 430 to the apparatus body 300.

After the recording sheet S has been re-fed, the image forming apparatus 1 causes a color image for the backside of the recording sheet S formed on the intermediate transfer belt 41 to be transferred to the recording sheet S secondarily similar to the case of the surface of the recording sheet S and causes the fixing device 60 to fix the secondarily transferred color image.

When the color image has been fixed entirely to the recording sheet S, the image forming apparatus 1 causes the recording sheet S on which the color image has been fixed to be discharged from the sheet discharger 14 onto the sheet discharge tray 15, and the recording sheet S is stacked thereon. Thus, the image forming operation is terminated.

Figure 2:
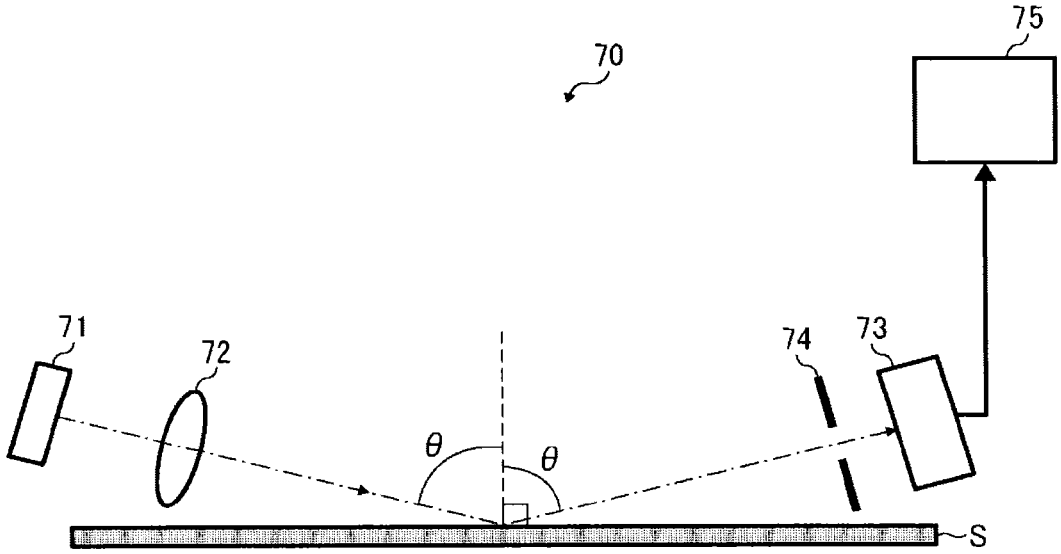
FIG. 2 is a schematic front view of an optical sensor according to an embodiment of the present invention.

FIG. 2 is a view illustrating a structure of the sheet sensor 70.

The sheet sensor 70 is constructed of a light source 71, a collimator lens 72, a specular reflected light sensor 73 serving as an optical sensor, an aperture 74, and a control circuit 75.

In the present embodiment, the light source 71 is formed of a vertical cavity surface emitting laser (VCSEL). Accordingly, the present light source 71 is more stable than a general light-emitting diode or facet laser diode (LD), can suppress far field pattern (FFP), and can provide a high precision optical system. Here, "FFP" means a beam divergence angle. The light source 71 may be formed of various other light sources such as LEDs other than the vertical cavity surface emitting laser (VCSEL).

The collimator lens 72 disposed between the light source 71 and an irradiated surface of the recording sheet S is a converging lens with an aspheric surface. The collimator lens 72 converts laser light beams emitted from the light source 71 into collimated light beams. Herein, "collimate" means to turn the laser beams emitted from the light source 71 into parallel beams neither divergent nor convergent. As a result, the collimated light beam means a laser beam adjusted to a parallel state.

The collimator lens 72 adjusts an incident angle of the laser beams emitted from the light source 71 to the recording sheet S and a parallelism of the collimated light beams, so that the sheet sensor 70 can improve the detection sensitivity of the smoothness of the recording sheet S.

The specular reflected light sensor 73 is disposed downstream of the reflected light surface of the recording sheet S in the light axis direction of the laser beams emitted from the light source 71, and is a photodiode to detect reflected specular light beams onto the recording sheet S.

The specular reflected light sensor 73 detects the light intensity of the specular light beams reflected from the recording sheet S as a voltage and outputs the detection result in the form of an output signal to the control circuit 75.

The aperture 74 is disposed between the irradiation surface of the recording sheet S and the specular reflected light sensor 73 and controls an incident angle of the reflected light beams incident to the specular reflected light sensor 73. By providing the aperture 74, the sheet sensor 70 secures quantity of reflected light beams reflected by the surface of the recording sheet S emitted from the light source 71 and controls the divergent light mixed in the reflected light beams, thereby preventing accuracy in the smoothness detection from decreasing.

The control circuit 75 is connected to the specular reflected light sensor 73 and calculates a smoothness of the recording sheet S from the sensor output detected by the specular reflected light sensor 73. Functions of the control circuit 75 will be described later.

With this configuration, the sheet sensor 70 obtains the smoothness of the recording sheet S via operation of the control circuit 75.

The thus-configured sheet sensor 70 detects the light power of the specular reflected light in the specular direction of the laser light beams emitted from the light source 71 to the recording sheet S, so that the smoothness on the surface of the recording sheet S can be detected. The sheet sensor 70 in the present embodiment functions as a smoothness detection means.

Figure 3:
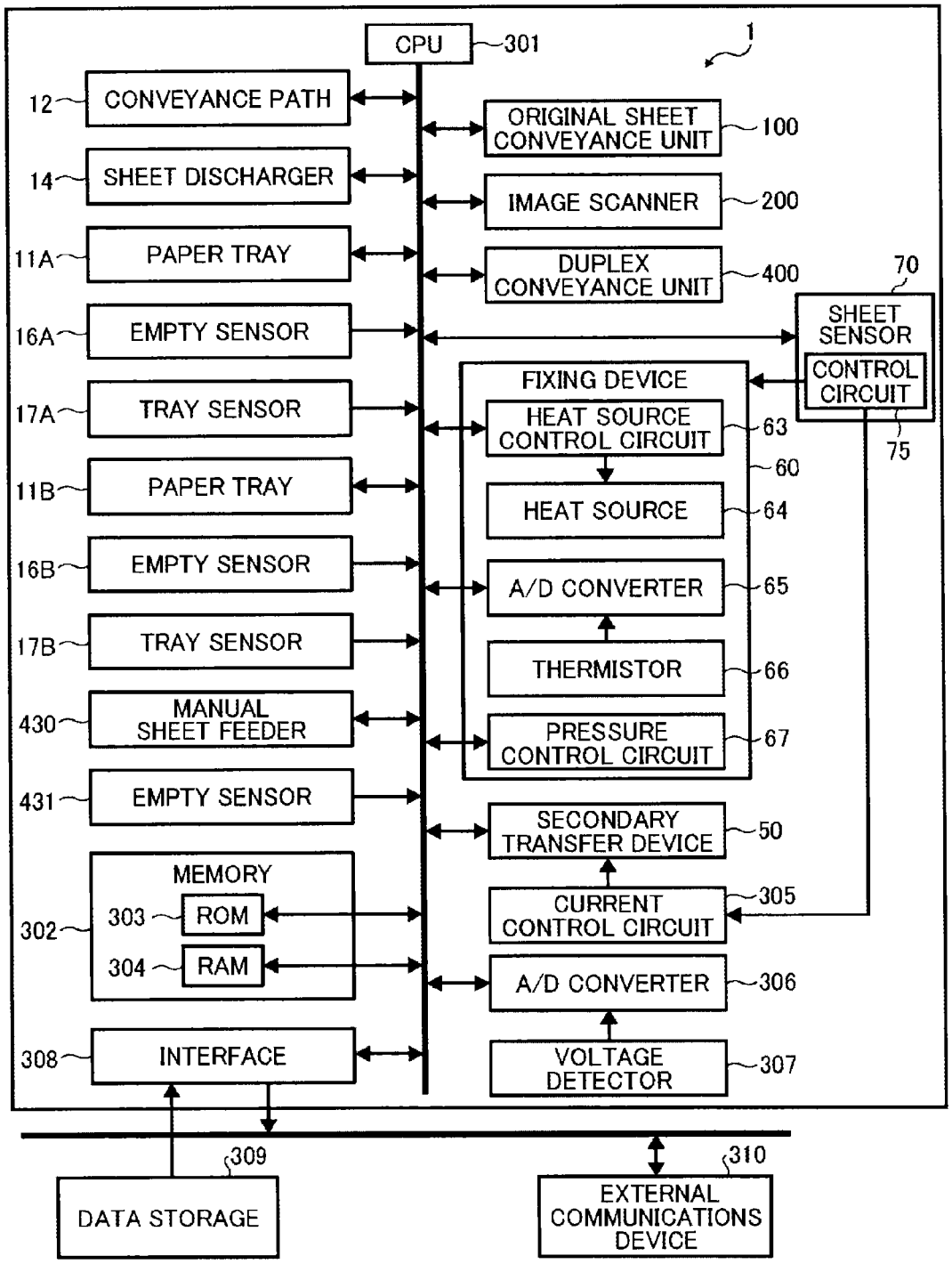
FIG. 3 is a functional block diagram of the image forming apparatus related to the embodiment of the present invention.

FIG. 3 is a functional block diagram illustrating architecture of the image forming apparatus 1.

As illustrated in FIG. 3, the image forming apparatus 1 includes a central processing unit (CPU) 301, disposed in the apparatus body 300, and various elements. The CPU 301 is connected to the various elements via a bus, so that the CPU 301 controls each element and the capabilities of the image forming apparatus 1 can be exerted.

The original sheet conveyance unit 100, the image scanner 200, and the duplex conveyance unit 400 are connected to the CPU 301 and can be driven or controlled by the CPU 301. In addition, the CPU 301 is further connected to the paper trays 11, the conveyance path 12, the sheet discharger 14, and the manual sheet feeder 430, and a drive system of each device is controlled, such that rollers 13A, 13B of the paper trays 11A and 11B are controlled by the CPU 301. Further, the CPU 301 is connected to the exposure device 20, the image forming device 30, the intermediate transfer device 40, the secondary transfer device 50, the registration roller pair 80, the conveyance roller pair 90, the fixing device 60, and the sheet sensor 70, although all of these devices are not illustrated in FIG. 3. Further, the CPU 301 is connected to a memory 302, a current control circuit 305, an analog-to-digital (A/D) converter 306, a voltage detector 307, and an interface 308.

An empty sensor 16A detects whether or not the recording sheet S contained in the upper paper tray 11A is empty and outputs a detection signal to the CPU 301. A tray sensor 17A detects whether or not the upper paper tray 11A is pulled out from the apparatus body 300 and outputs a detection signal to the CPU 301.

Similarly, an empty sensor 16B that detects whether or not the recording sheet S contained in the lower paper tray 11B is empty outputs a detection signal to the CPU 301 and a tray sensor 17B that detects whether or not the lower paper tray 11B is pulled out from the apparatus body 300 outputs a detection signal to the CPU 301.

Further, an empty sensor 431 detects whether or not the recording sheet S contained in the manual sheet feeder 430 is empty and outputs a detection signal to the CPU 301.

Accordingly, the CPU 301 determines that the state of the paper tray has changed when the empty sensors 16A, 16B, and 431 detect that the paper tray is vacant and when the tray sensors 17A, 17*b* detect that the paper trays 11A and 11B are pulled out from the apparatus body 300.

It is noted that the upper paper tray 11A, the lower paper tray 11B, and the manual sheet feeder 430 are containers to contain the recording sheet S. In addition, the empty sensors 16A, 16B, and 431 and the tray sensors 17A, 17*b* function as status sensors to detect a storage status of the recording sheet S. Further, because the manual sheet feeder 430 is installed at a side of the duplex conveyance unit 400 when not in use, another sensor to detect whether or not the manual sheet feeder 430 is disposed angled relative to the side of the duplex conveyance unit 400 (as illustrated in FIG. 1) can be provided, similarly to the above-described tray sensors 17A, 17B.

The fixing device 60 includes a heat source 64 of the heat roller 61, a heat source control circuit 63, and a thermistor 66 to detect a temperature of the heat source 64. The heat source control circuit 63 determines a heat quantity to be supplied to the heat source 64, that is, a target fixing temperature.

Herein, to obtain a high-quality image as described above, the target fixing temperature should be determined considering the smoothness, which has a very high correlation with the fixing quality. Accordingly, the control circuit 75 determines the target fixing temperature set for the heat source control circuit 63 according to the sensor value from the sheet sensor 70 that detects the smoothness of the surface of the recording sheet S.

In addition, the fixing device 60 includes an A/D converter 65 that converts an analog value detected by the thermistor 66 into a digital value and sends the converted digital value to the CPU 301 to be processed by the CPU 301. In addition, the fixing device 60 includes a pressure control circuit 67 that controls pressure of the pressure roller 62 pressing the heat roller 61 and thus a width of the nip portion formed thereby.

In addition, because the control circuit 75 of the sheet sensor 70 is connected to the fixing device 60, a signal sent from the control circuit 75 is received by the fixing device 60, so that the heat source control circuit 63 and the pressure control circuit 67 are controlled. As such, the control circuit 75 in the present embodiment serves as a means to control the temperature.

The memory 302 includes a read-only memory (ROM) 303 and a random access memory (RAM) 304. The ROM 303 includes program codes and patterns to control fixation that allows the CPU 301 to execute. The RAM 304 temporarily stores detected voltages.

The CPU 301 reads the program codes stored in the ROM 303 and loads the data into the RAM 304. While using the RAM 304 as a data buffer, the CPU 301 executes each program defined by the program codes and controls each element.

The current control circuit 305 receives a signal sent from the control circuit 75 of the sheet sensor 70 and controls transfer current values when the secondary transfer device 50 transfers a toner image to a recording sheet S.

The A/D converter 306 converts analog voltages detected by the voltage detector 307 into digital values to be processed by the CPU 301, and sends them to the CPU 301.

The interface 308 serves as an interface for the connection with a data storage 309 such as a hard disk drive and an external communications device 310 such as a personal computer, and thus, image data is transferred from an external device to the image forming apparatus 1.

In the image forming apparatus 1 according to the present embodiment, a representative smoothness (M) is obtained from various smoothness values obtained for each of the plurality of recording sheets S to set a more appropriate target fixing temperature, and the target fixing temperature is corrected depending on the representative smoothness (M).

Figure 4:
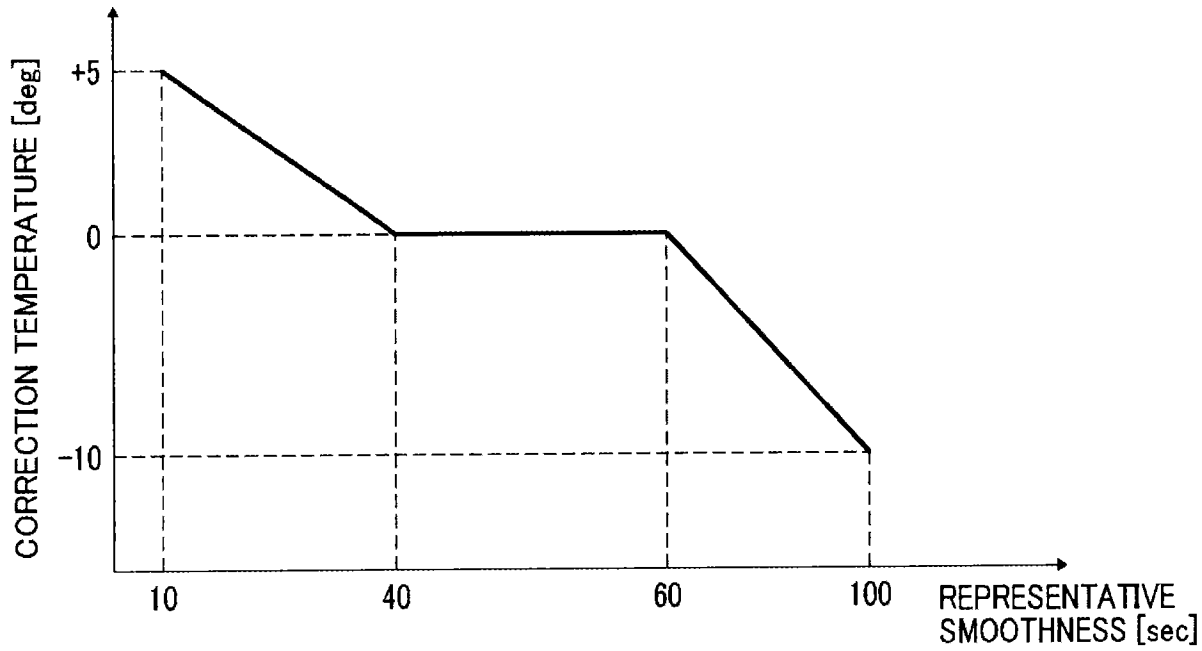
FIG. 4 is a graph depicting a relation between representative smoothness and corrected temperature according to the embodiment of the present invention.

The representative smoothness (M) is used to determine a corrected temperature from a correction temperature list relative to the prescribed representative smoothness (M) as illustrated in FIG. 4. In actuality, an increase or decrease in the correction temperature is set as the target set temperature relative to the current target fixing temperature of the fixing device 60.

When any of the empty sensors 16A, 16B, 431 and the tray sensors 17A, 17B detects a change in the status of the recording sheet S, the detection value stored in the memory 302 is reset and the status returns to an original state. Specifically, when the detection value is reset, the increase or decrease in the correction temperature is set to substantially zero '0'.

Thus, in the present embodiment, the target fixing temperature of the fixing device 60 is obtained as follows: First, a previous detection value and a next detection value of the recording sheet S detected by the sheet sensor 70 are sequentially stored in the memory 302, so that an average smoothness (m) is obtained. Next, a representative smoothness (M) is calculated using the average smoothness (m) and a standard deviation (σ), and an increase and decrease value is determined based on the representative smoothness (M).

Figure 5:
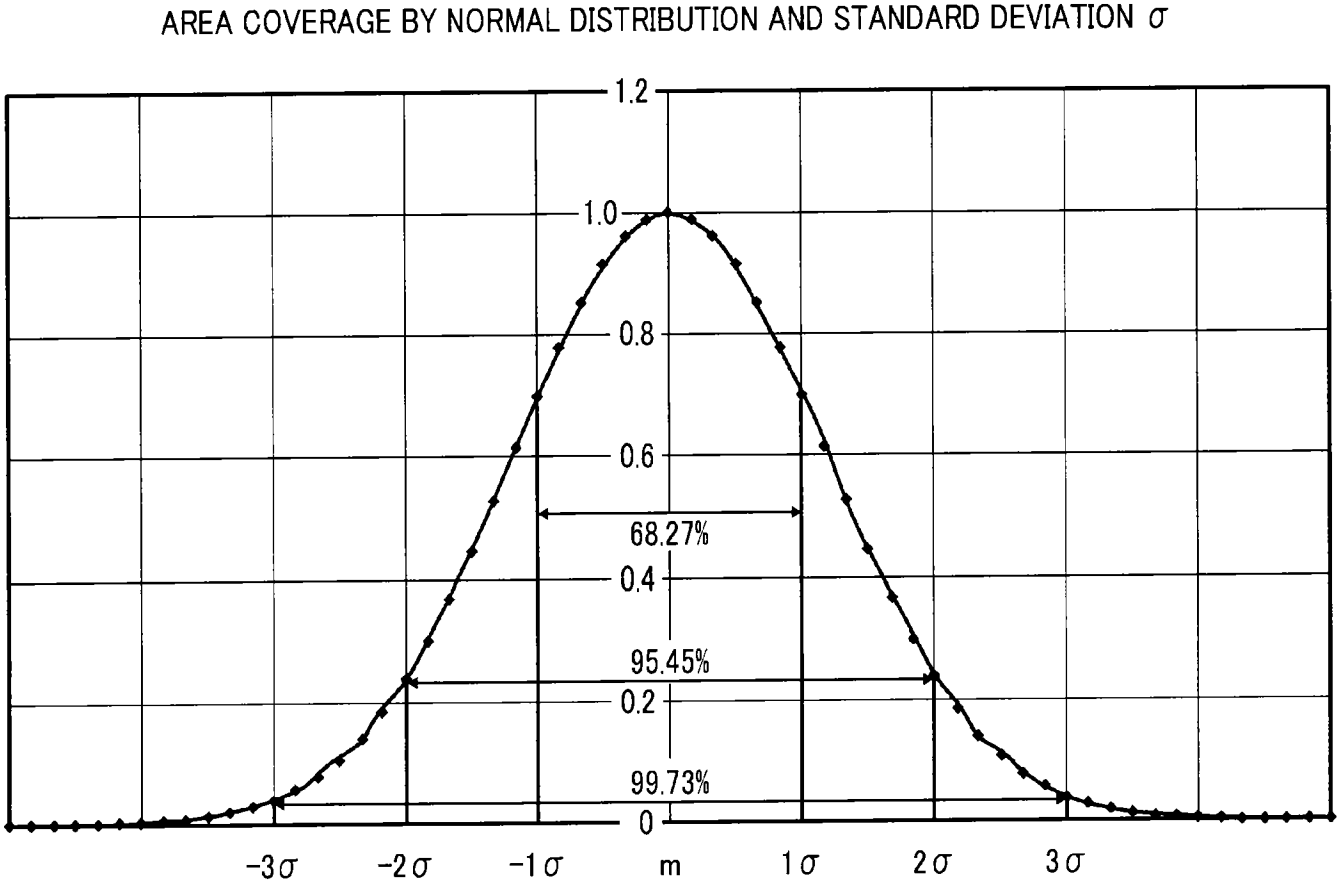
FIG. 5 is a graph depicting a relation of area coverage between normal distribution and standard deviation according to the embodiment of the present invention.

Herein, as illustrated in FIG. 5, a coefficient A of the standard deviation (σ) used in calculating the representative smoothness (M) is preferably 3, based on ±δ3 in which 99.7% of area in a normal distribution based on the average smoothness (m) can be covered.

Figure 6:
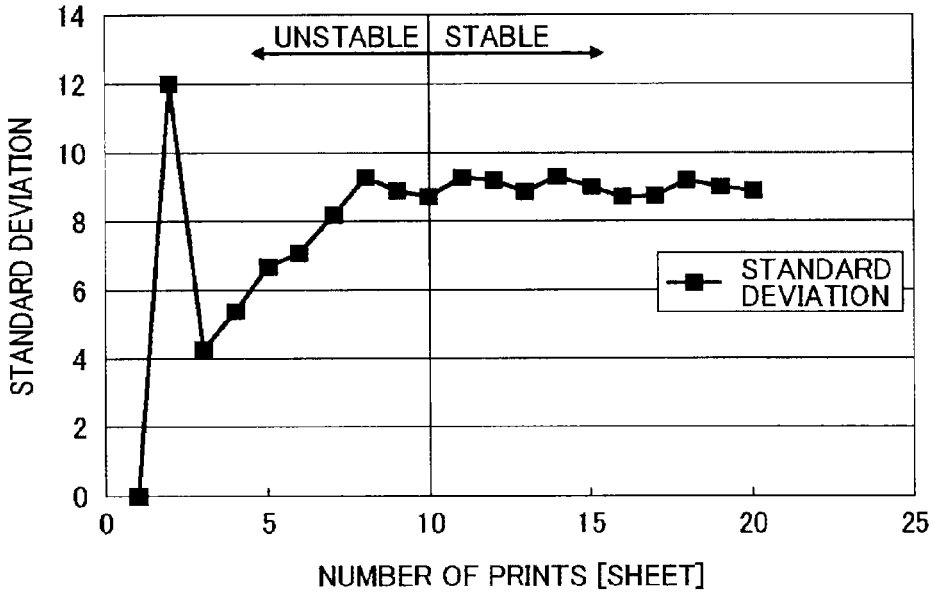
FIG. 6 is a graph depicting an example of change between a number of prints and the standard deviation according to the embodiment of the present invention.

In addition, a number of prints B of the reset timing to correct the representative smoothness (M) in a calculation formula may be an 8th sheet as illustrated in FIG. 6 in which the standard deviation becomes stable; however, because the greater number is more preferable from the view of stability, a 10th sheet is suitable.

Figure 7:
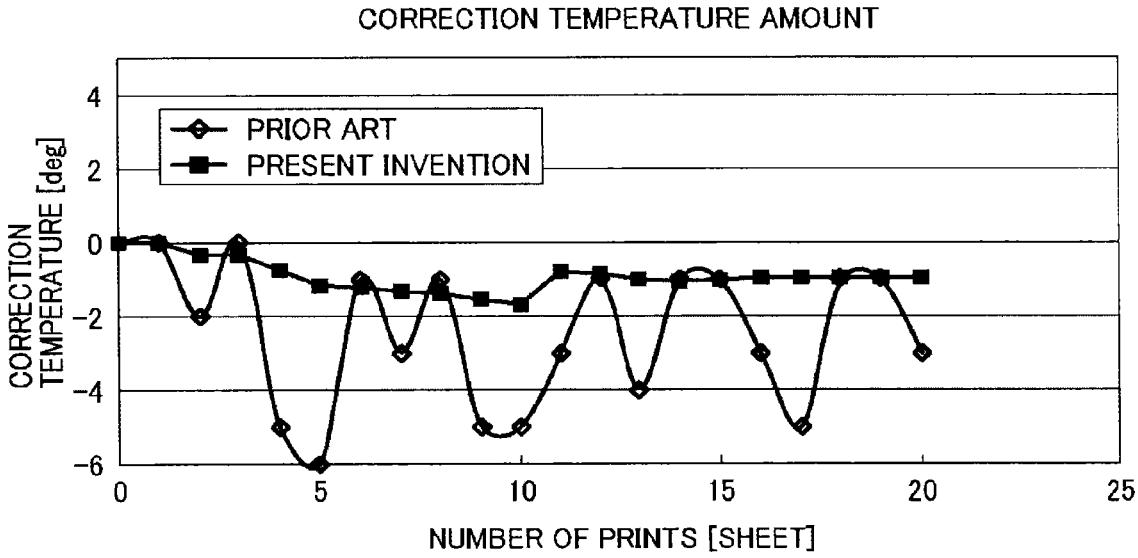
FIG. 7 is a graph comparing the change of correction temperature for a conventional number of prints and the change of correction temperature for a number of prints according to the present invention.

Accordingly, as illustrated in FIG. 7, compared to a case in which a correction is not performed based on the representative smoothness (M), the increase and decrease value of the correction temperature can be more stable when the correction based on the representative smoothness (M) is performed.

Accordingly, an appropriate target fixing temperature to which temperature correction is applied can be obtained, so that the fixing operation at the target fixing temperature can be performed quickly, and the temperature control relating to the fixing process can be performed effectively.

More specifically, the target fixing temperature of the fixing device 60 is determined for the following recording sheet S in response to the detected smoothness.

Figure 8:
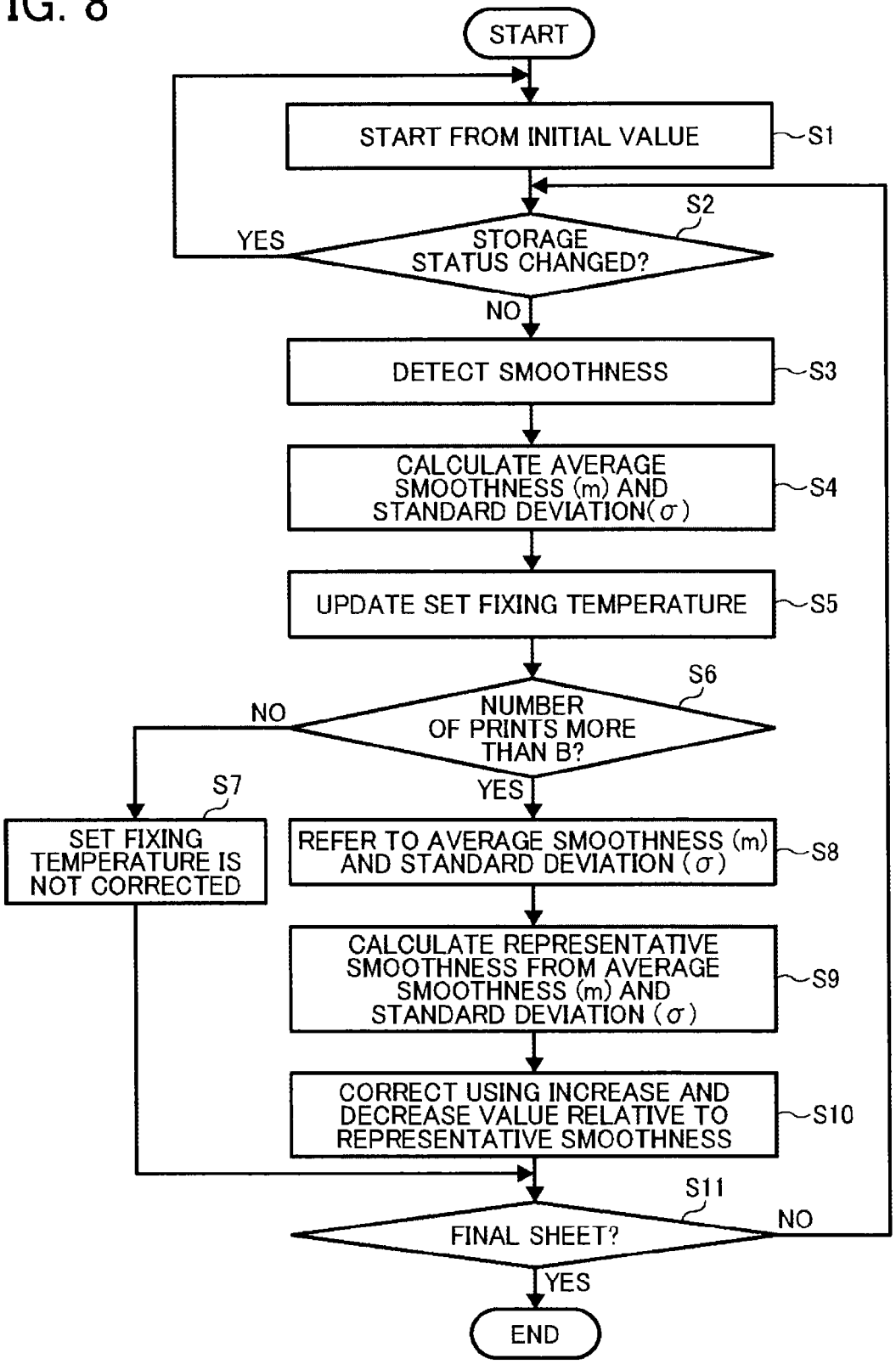
FIG. 8 is a flowchart illustrating correction of a fixing temperature in a fixing device according to the embodiment of the present invention.

Next, with reference to FIG. 8, a determination of the target fixing temperature according to the present embodiment will be described.

In Step S1, the CPU 301 controls the heat source control circuit 63 with a preset initial value, that is, a target fixing temperature set as an initial value based on a sheet thickness and a smoothness of an A4 regular sheet, that is regularly used as a recording sheet S, and causes the heat source control circuit 63 to perform an image forming process.

Next, in Step S2, the CPU 301 detects a storage status of the recording sheet S contained in paper trays 11 or a manual sheet feeder 430, and in particular, a paper tray 11A or 11B selected by a user or automatically by the CPU 301.

Specifically, each empty sensor 16A, 16B, 431 or the tray sensor 17A, 17B performs detection to detect whether or not there is a possibility that the smoothness of the recording sheet S has changed due to, for example, a replacement of the recording sheet S.

Herein, when it is detected that the recording sheet S is not replaced (NO) and that the image forming process is performed, the CPU 301 controls the heat source control circuit 63 such that the image forming process is performed with the same target fixing temperature as in the previous image forming process.

On the other hand, when it is detected that the recording sheet S is replaced (YES) and that the image forming process is performed, the CPU 301 resets the target fixing temperature set in the previous image forming process and the detection value stored in the memory 302 and controls the heat source control circuit 63 with an initial value.

Note that the present storage status change is, if detected by the empty sensor 16A, 16B, or 431, recognized as an interrupt signal, resetting is not always performed in the timing of Step S2. In addition, when the empty sensor 16A, 16B, or 431 detects a storage state change, there are many cases in which a same type of recording sheet S is replenished. In such a case, there is no need of resetting the initial value.

Then, in Step S3, the CPU 301 starts conveyance of the recording sheet S, causes the registration roller pair 80 to correct skew of a previous recording sheet $S_1$ and the sheet sensor 70 to detect the smoothness at a time of registration such as a secondary transfer timing adjustment.

In Step S4, the CPU 301 calculates an average smoothness (m) based on the detection value stored in the memory 302. Herein, when resetting to an initial value is not performed in Step S2, even though the recording sheet S is for the 1st image forming process, the memory 302 includes detection values stored in the past before the previous time.

As a result, in Step S4, the CPU 301 obtains an average smoothness (m) according to a formula 1 and stores the obtained value in the memory 302, wherein "m" is the average smoothness of the detection value stored in the memory 302, "Xi" is a variable stored in the memory 302, "N" is a number of recording sheets S supplied, and "σ" is the standard deviation.

$$m = \frac{1}{N}\sum_{i=1}^{N} x_i \quad \text{[Formula 1]}$$

In addition, in Step S3, the CPU 301 calculates a standard deviation (σ) by a dispersion formula 2 and stores the obtained value in the memory 302.

$$\sigma^2 = \frac{1}{N}\sum_{i=1}^{N} (x_i - m)^2 \quad \text{[Formula 2]}$$

In Step S5, the CPU 301 controls the heat source control circuit 63 to change the target fixing temperature using the average smoothness (m) and the standard deviation (σ).

Herein, for example, in the case of using a regular sheet having a high smoothness, because the change in the detected value detected by the sheet sensor 70 is small, the average smoothness (m) does not change drastically. As a result, in such a case, the CPU 301 controls the heat source control circuit 63 to change the target fixing temperature using the average smoothness (m) or its approximation.

By contrast, for example, when a recording sheet S having a large surface roughness is used, change in the detection value detected by the sheet sensor 70 is large, so that the average smoothness (m) changes a lot. When the variations in the smoothness are large, the target fixing temperature varies for each recording sheet S, so that the temperature control is unstable. As a result, in such a case, the CPU 301 controls the heat source control circuit 63 to change the target fixing temperature using the standard deviation (σ) or its approximation.

Next, in Step S6, the CPU 301 determines whether or not the number (N) of prints used in calculating the average smoothness (m) reaches a prescribed number B, for example, 10 sheets.

When the CPU 301 determines that the number (N) of prints does not reach the prescribed number B (10 sheets) (NO in S6), the CPU 301 does not perform correction of the target fixing temperature (Step S7), and the process moves to a Step S11 with the target fixing temperature updated in Step S5.

On the other hand, when the CPU 301 determines that the number (N) of prints reaches the prescribed number B (10 sheets) (YES in Step S6), referring to the average smoothness (m) and the standard deviation (σ) stored in the memory 302 (Step S8), the CPU 301 calculates a representative smoothness (M) by a formula M=m−Aσ, in which M is the representative smoothness and A is a rational number (in Step S9).

In Step S10, the CPU 301 outputs a correction value according to the representative smoothness (M) to the control circuit 75. As a result, the control circuit 75 outputs a control signal obtained by adding a correction value to or subtracting a correction value from the target fixing temperature, to the heat source control circuit 63 and controls it, and the CPU 301 repeats the above routine until the end of the image forming process (Step S11).

As described heretofore, the image forming apparatus according to the present embodiment includes the paper trays 11, 430 to contain the recording sheet S and feed it, the empty sensors 16A, 16B, and 431 or the tray sensors 17A and 17B to detect the storage status of the recording sheet S contained in the paper trays 11, 430, the sheet sensor 70 to detect the smoothness in a prescribed area on the surface of the recording sheet S, the memory 302 to store the detection value of the smoothness detected by the sheet sensor 70, the fixing device 60 to heat and press the toner image transferred onto the recording sheet S and fix it onto the recording sheet S, and the control circuit 75 to determine the target fixing temperature of the fixing device 60 based on the detection values stored in the memory 302. The control circuit 75 stores the detection value of the previous recording sheet S detected by the sheet sensor 70 to the memory 302, and causes to sequentially detect a smoothness of the successive recording sheets S and to store the detection value to the memory 302. The control circuit 75 determines the target fixing temperature for the successive recording sheets S depending on the detected smoothness. The sensors 16A, 16B, 431, 17A, and 17B each detect a change in the storage status of the paper trays 11, 430 and the detection value stored in the memory 302 is reset to zero, thereby reducing the time to change the target fixing temperature of the fixing device 60 for the recording sheet S in a case in which it is forecasted that the smoothness of the recording sheet S changes.

In the above embodiment, a case in which the recording sheet $S_1$ to $S_n$ are fed from a same paper tray (for example, the paper tray 11A) in the image forming process relative to a same print job has been described, but the present invention is not limited thereto. For example, the present embodiment of the invention can be applied to an image forming process of a mixed mode related to a series of print jobs using a copier function and different sizes (A4 and A3) of recording sheets S, that is, fed from different paper trays (for example, the paper trays 11A and 11B). In such a mixed mode, the CPU 301 switches the paper trays 11A and 11B depending on the change of the sizes of the originals detected by the original sheet conveyance unit 100, and therefore, the detection value can be reset at the time of switching.

According to the image forming apparatus as disclosed herein, there is such an effect that the time to change the target fixing temperature of the fixing device can be reduced when it is prospected that the smoothness of the recording sheet will change, and further, the present invention may be applied to a copier, a facsimile machine, a printer, and a multifunction apparatus using the capabilities of the above devices in combination.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

paper trays to contain and feed a recording sheet on which a toner image is transferred;

status sensors to detect a storage status of the recording sheet contained in the paper trays;

a sheet sensor to detect a smoothness in a prescribed area on a surface of the recording sheet;

a memory to store a detection value of the smoothness detected by the sheet sensor;

a fixing device to heat and press the toner image transferred onto the recording sheet and fix the toner image onto the recording sheet; and a control circuit to determine a fixing temperature of the fixing device based on detection value stored in the memory, wherein the control circuit is configured to set a first fixing temperature of the fixing device based on a preset value, cause the sheet sensor to sequentially detect a smoothness of a successive recording sheet and to store a detection value of the smoothness of the successive recording sheet into the memory, calculate an average smoothness based on the detection value of the successive recording sheet stored in the memory and detection values of immediately previous recording sheets detected prior to the successive recording sheet that are stored in the memory, set the fixing device to a second fixing temperature from the first fixing temperature based on at least the average smoothness, and reset the detection values stored in the memory to zero and set the fixing device to the first fixing temperature when the status sensors detect a change in the storage status of the paper trays.

2. The image forming apparatus as claimed in claim 1, wherein, when "m" is the average smoothness of the detection values stored in the memory, "Xi" is a variable stored in the memory, and "N" is a number of recording sheets supplied, the control circuit obtains the average smoothness m according to a formula 1, stores the average smoothness m in the memory, and determines the target fixing temperature of the fixing device using the average smoothness m or an approximation thereof, and wherein the formula 1 is $$m = \frac{1}{N}\sum_{i=1}^{N} x_i.$$

3. The image forming apparatus as claimed in claim 1, wherein when "m" is the average smoothness of the detection values stored in the memory, "Xi" is a variable stored in the memory, "N" is a number of recording sheets supplied, and "σ" is a standard deviation, the control circuit obtains the average smoothness m and the standard deviation σ by a formula 1 and a formula 2, stores the average smoothness m and the standard deviation σ in the memory, and determines the target fixing temperature of the fixing device using the average smoothness m and the standard deviation σ or approximations thereof, and wherein the formula 1 is $$m = \frac{1}{N}\sum_{i=1}^{N} x_i,$$

and the formula 2 is $$\sigma^2 = \frac{1}{N}\sum_{i=1}^{N} (x_i - m)^2.$$

4. The image forming apparatus as claimed in claim 3, wherein, when "M" is a representative smoothness of the recording sheet stored in the paper tray and "A" is a rational number, the control circuit determines the target fixing temperature of the fixing device using the representative smoothness M, and wherein the representative smoothness M is obtained by a formula M=m−Aσ.

5. The image forming apparatus as claimed in claim 3, wherein, when "M" is a representative smoothness of the recording sheet stored in the paper tray, "A" is a rational number, "N" is the number of recording sheets supplied, and "B" is a prescribed number of recording sheets, the control circuit determines the target fixing temperature of the fixing device using the representative smoothness M, and wherein the representative smoothness M is obtained by a formula M=m when N<B and a formula M=m—Aσ when N≥B.

6. The image forming apparatus as claimed in claim 1, wherein the control circuit is configured to reset the detection values stored in the memory to zero and set the fixing device to the first fixing temperature when the status sensors detect an opening or a closing of at least one of the paper trays.

7. The image forming apparatus as claimed in claim 1, wherein the control circuit is further configured to determine a number of successive recording sheets since the last reset of the detection values, and set the fixing device to a third fixing temperature from the second fixing temperature if the number of sheets is greater than a predetermined number of sheets.

8. The image forming apparatus as claimed in claim 7, wherein the third fixing temperature is based on the average smoothness and a standard deviation of the smoothness which is based on the detection value of the successive recording sheet stored in the memory and the detection values of immediately previous recording sheets detected prior to the successive recording sheet that are stored in the memory.

* * * * *